US011521589B2

(12) United States Patent
Tomimatsu

(10) Patent No.: US 11,521,589 B2
(45) Date of Patent: Dec. 6, 2022

(54) SOUND ABSORPTION STRUCTURE

(71) Applicant: Yamaha Corporation, Hamamatsu (JP)

(72) Inventor: Kiyoyuki Tomimatsu, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 457 days.

(21) Appl. No.: 16/672,587

(22) Filed: Nov. 4, 2019

(65) Prior Publication Data

US 2020/0143787 A1 May 7, 2020

(30) Foreign Application Priority Data

Nov. 5, 2018 (JP) ..... JP2018-208147

(51) Int. Cl.
*G10K 11/172* (2006.01)

(52) U.S. Cl.
CPC ..... *G10K 11/172* (2013.01)

(58) Field of Classification Search
CPC ..... G10K 11/172
USPC ..... 181/175
See application file for complete search history.

(56) References Cited

U.S. PATENT DOCUMENTS 3,819,009 A 6/1974 Motsinger
4,106,587 A 8/1978 Nash et al.
6,627,791 B1 * 9/2003 Veglio ..... A61F 13/5146 604/383
7,337,875 B2 3/2008 Proscia et al.
7,413,053 B2 * 8/2008 Wasif ..... F23M 20/005 181/292
7,913,813 B1 3/2011 Mathur
8,381,872 B2 * 2/2013 Alexander ..... G10K 11/162 52/145
9,962,851 B2 * 5/2018 Slama ..... B26F 3/10
10,755,687 B2 * 8/2020 Pauley ..... G10K 11/172
10,876,479 B2 12/2020 Roach et al.
11,027,817 B2 6/2021 Porte et al.
11,223,886 B1 1/2022 Fadul et al.
11,240,592 B2 2/2022 Miki et al.
2012/0037449 A1 * 2/2012 Ayle ..... G10K 11/172 29/896.2
2013/0118831 A1 5/2013 Kawai et al.
(Continued)

FOREIGN PATENT DOCUMENTS

CN 109243419 A * 1/2019 ..... G10K 11/162
JP 2-71300 A 3/1990
JP 5-143081 A 6/1993
(Continued)

OTHER PUBLICATIONS

United States Non-Final Office Action issued in U.S. Appl. No. 16/672,645 dated Mar. 1, 2022 (ten (10) pages).
(Continued)

*Primary Examiner* — Forrest M Phillips
(74) *Attorney, Agent, or Firm* — Crowell & Moring LLP

(57) ABSTRACT

A sound absorption structure includes resonators that constitute separate bodies from each other and that produce Helmholtz resonance and a pliable coupling member that couples the plurality of resonators. Each of the resonators has a tubular shape or a pipe shape, includes an opening portion provided on a first end face, and includes a bottom portion provided on a second end face that is an opposite end face to the first end face. Each of the resonators is pliable.

5 Claims, 8 Drawing Sheets

(56) References Cited

U.S. PATENT DOCUMENTS

| | | | | |
|---|---|---|---|---|
| 2019/0115005 | A1* | 4/2019 | Pauley | G10K 11/172 |
| 2019/0147843 | A1 | 5/2019 | Fairgrieve et al. | |

FOREIGN PATENT DOCUMENTS

| | | | | |
|---|---|---|---|---|
| JP | 7-90952 | A | 4/1995 | |
| JP | 8-6570 | A | 1/1996 | |
| JP | 2005-31240 | A | 2/2005 | |
| JP | 2013-8012 | A | 1/2013 | |
| JP | 2017-198723 | A | 11/2017 | |
| WO | WO-2008096630 | A1 * | 8/2008 | G10K 11/172 |

OTHER PUBLICATIONS

Japanese-language Office Action issued in Japanese Application No. 2018-208148 dated Jul. 26, 2022 with English translation (10 pages).

Japanese-language Office Action issued in Japanese Application No. 2018-208147 dated Aug. 2, 2022 with English translation (11 pages).

United States Final Office Action issued in U.S. Appl. No. 16/672,645 dated Jul. 13, 2022 (eight (8) pages).

* cited by examiner

SOUND ABSORPTION STRUCTURE

CROSS REFERENCE TO RELATED APPLICATION

This application claims priority from Japanese Patent Application No. 2018-208147, filed Nov. 5, 2018, the entire contents of which are incorporated herein by reference.

BACKGROUND OF THE INVENTION

Field of the Invention

The present disclosure relates to a sound absorption structure.

Description of Related Art

Sound absorption structures using Helmholtz resonance are known. For example, a sound absorption structure described in Japanese Patent Application Laid-Open Publication No. 2013-008012 (hereinafter, Patent Document 1) includes a planar member having opening portions, and an air layer is provided between the planar member and a wall body. The sound absorption structure described in Patent Document 1 further includes extension members that are connected to the respective opening portions of the planar member. At least a part of each of the extension members is housed in the air layer and is separated from the wall body. A plasterboard is used for the planar member in Patent Document 1.

However, the sound absorption structure described in Patent Document 1 has the following problems A and B.

A) The problem A is that the planar member cannot be installed along a wall surface when the wall surface is curved because the planar member is substantially a rigid body.

B) The problem B is that, if the planar member is formed of a pliable member, it is difficult to make the distance between the planar member and the wall body uniform, and a desired sound absorption effect is difficult to obtain because the extension members need to be separated from the wall body.

If the extension members are in contact with the wall body, openings of the extension members in the air layer are blocked, and thus, the sound absorption effect cannot be obtained.

SUMMARY

In view of circumstances described above, the present disclosure has an object to provide a desired sound absorption effect even in a case in which a wall surface of a wall body is a curved surface.

In order to solve the above problems, a sound absorption structure according to a preferred aspect according to the present disclosure includes a plurality of resonators that constitute separate bodies from each other and that produce Helmholtz resonance, and a pliable coupling member that couples the plurality of resonators.

DESCRIPTION OF THE EMBODIMENTS

1. First Embodiment

Figure 1:
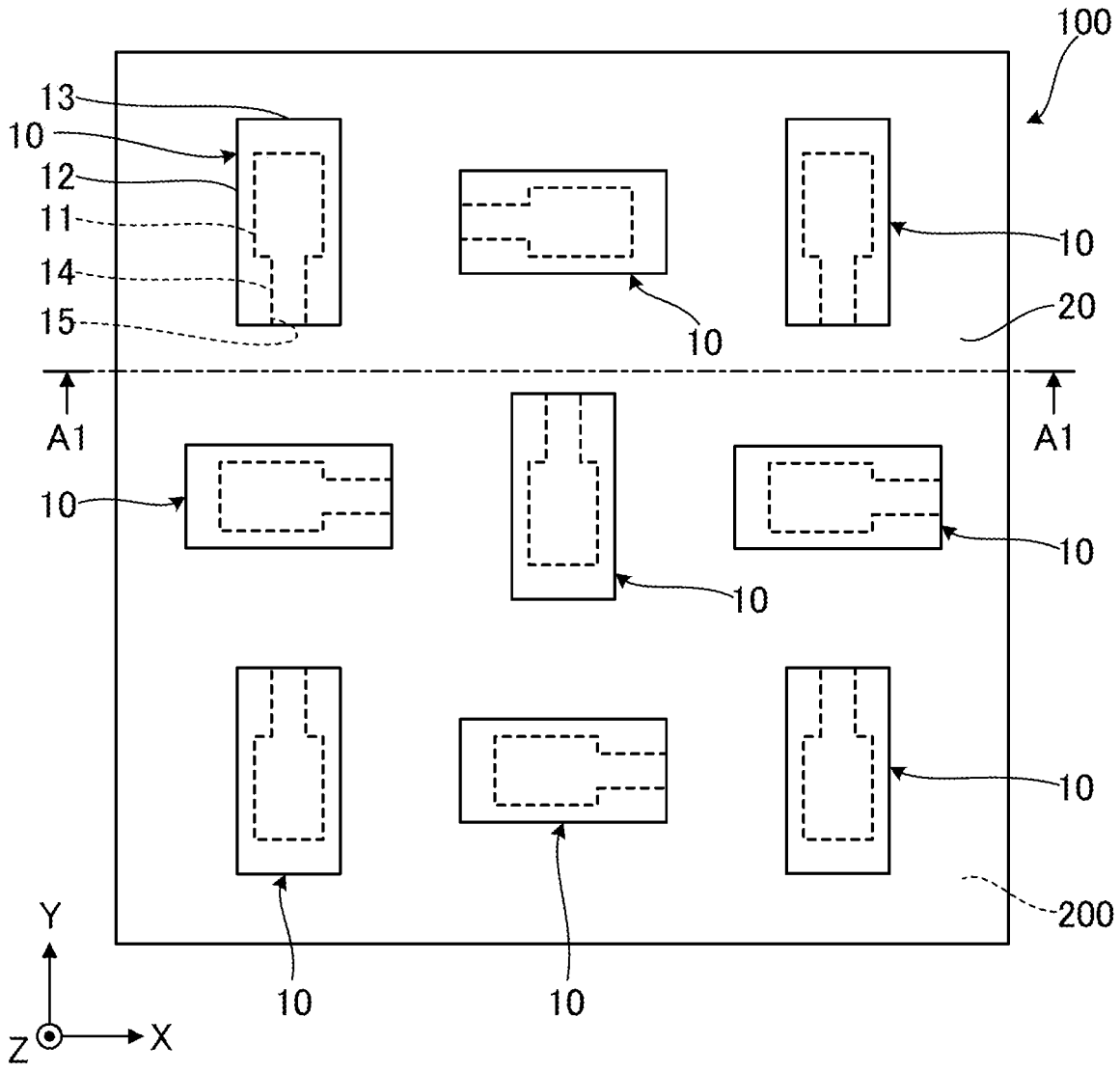
FIG. 1 is a plan view of a sound absorption structure according to a first embodiment.

A first embodiment of the present disclosure is explained below with reference to the drawings. It is of note that the dimensions and scales of parts in the drawings may be different from actual products as appropriate. Embodiments described below are preferred specific examples of the present disclosure. Therefore, various technically preferable limitations are added to the present embodiments. However, the scope of the present disclosure is not limited to these embodiments unless there are descriptions particularly limiting the present disclosure in the following explanations.

Figure 2:
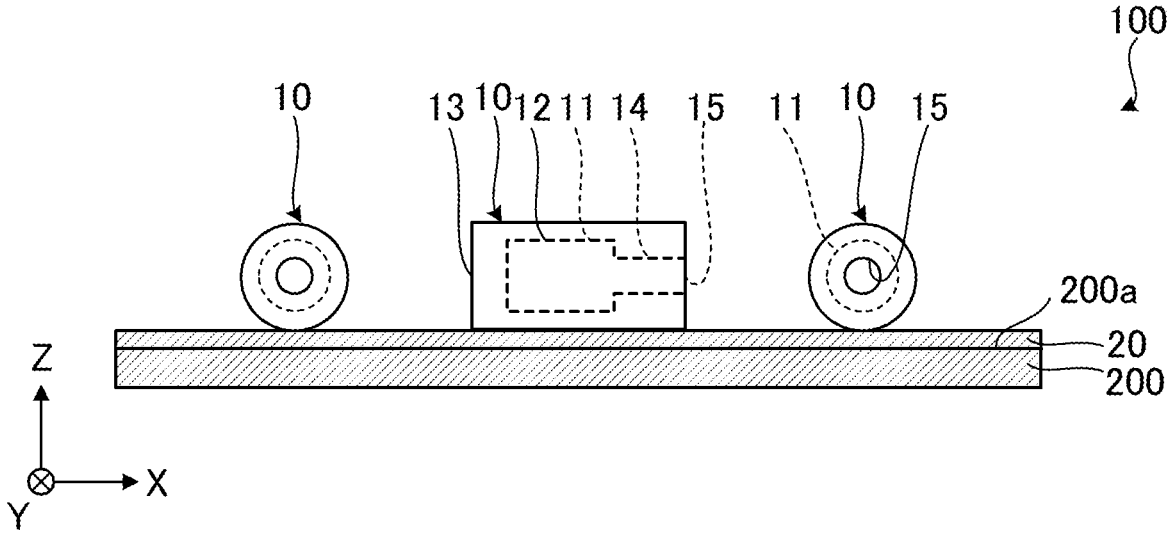
FIG. 2 is a cross-sectional view taken along a line A1-A1 in FIG. 1.

FIG. 1 is a plan view of a sound absorption structure 100 according to the first embodiment. FIG. 2 is a cross-sectional view taken along a line A1-A1 in FIG. 1. The sound absorption structure 100 shown in FIGS. 1 and 2 is a structure that absorbs sound using Helmholtz resonance. The sound absorption structure 100 includes resonators 10 that absorb sound by Helmholtz resonance, and a coupling member 20 that couples the resonators 10.

Parts of the sound absorption structure 100 are explained below in sequence. As shown in FIGS. 1 and 2, a certain direction (a left or right direction in FIG. 1) along a wall surface 200*a* of a wall body 200 is referred to as an "X direction", a direction (an upper or lower direction in FIG. 1) orthogonal to the X direction along the wall surface 200*a* is referred to as a "Y direction", and a direction normal to the wall surface 200*a* is referred to as a "Z direction" in the following explanations. The right side in FIG. 1 is a positive side of the X direction and the left side is a negative side of the X direction. The upper side in FIG. 1 is a positive side of the Y direction and the lower side is a negative side of the Y direction. The near side of the drawing of FIG. 1 is a positive side of the Z direction and the far side is a negative side of the Z direction. A state as viewed from the Z direction is referred to as "planar view" in the following explanations.

The coupling member 20 is a member that couples the resonators 10. The coupling member 20 of the present embodiment is a planar or sheet-like member. Therefore, the coupling member 20 is easy to handle before installation or when installing the sound absorption structure 100. The resonators 10 are bonded to one of faces of the coupling member 20 with an adhesive, a pressure-sensitive adhesive, or the like. The other face of the coupling member 20 is attached to the wall body 200 having the wall surface 200*a* as an installation face. The wall body 200 is, for example, a casing of an acoustic device (e.g., a speaker system), a panel used as a door or the like of a movable body (e.g., a vehicle), an inner wall of a building, or a structure fixed to any of these parts. The coupling member 20 is attached to the wall body 200 with, for example, an adhesive, a pressure-sensitive adhesive, or screws. It will be explained later with respect to an application example of a case in which the sound absorption structure 100 is installed on a speaker system or a vehicle door.

The coupling member 20 is pliable. In other words, the coupling member 20 is flexible. Because of the pliability of the coupling member 20, the coupling member 20 can be deformed along the wall surface 200*a* to be arranged thereon even if the wall surface 200*a* of the wall body 200 is curved. A thickness t of the coupling member 20 is determined according to the strength, ease in handling, and the like, required for the coupling member 20. The thickness t is preferably, for example, not less than 1 millimeter and not greater than 10 millimeters so that the coupling member 20 is pliable, although this is not particularly so limited. Examples of the constituent material of the coupling member 20 include an elastomer material, a resin material, or a metallic material, although not particularly limited thereto. The coupling member 20 itself may be formed of an adhesive material. The coupling member 20 may be formed of a dense body or a porous body. When the coupling member 20 formed of a porous body, the coupling member 20 realizes sound absorption in a frequency band different from a frequency band in which the resonators 10 can absorb sound. Examples of a porous body include glass fiber, felt, and urethane foam. It is of note that the shape or size of the coupling member 20 in planar view is not limited to that in the example shown in FIG. 1 and it may be appropriately set according to its installation location, sound absorption characteristics, and the like of the sound absorption structure 100.

Each of the resonators 10 is a resonator that produces Helmholtz resonance. The resonators 10 constitute separate bodies from each other. Therefore, the capacity of each of the resonators 10 is unchanged regardless of its orientation. Accordingly, a desired sound absorption effect is obtained even in a case in which the wall surface 200*a* of the wall body 200 is curved.

Figure 3:
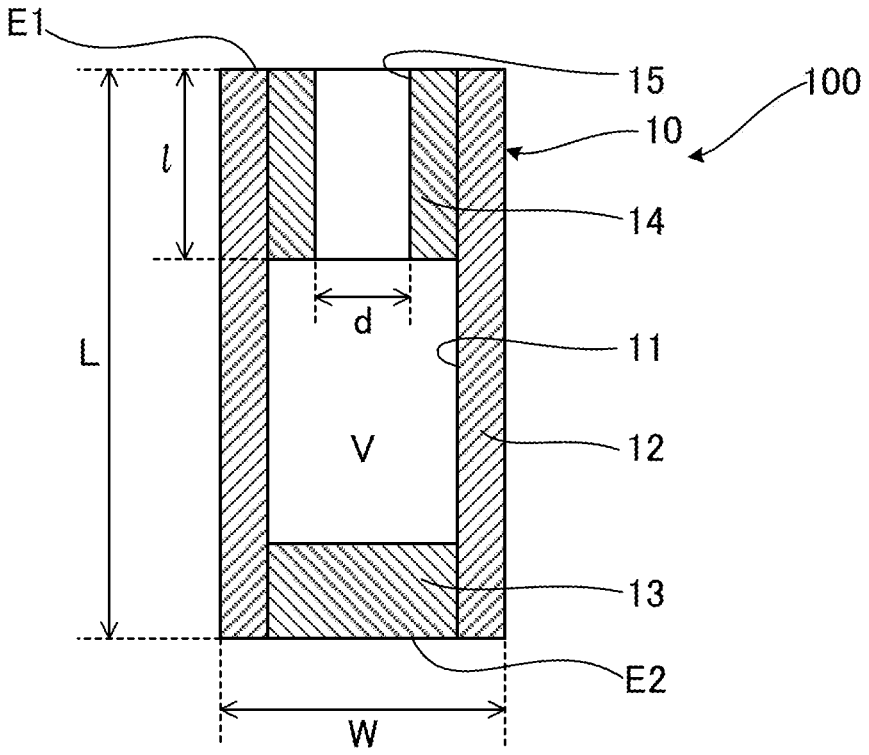
FIG. 3 is a vertical cross-sectional view of resonators in the first embodiment.

FIG. 3 is a vertical cross-sectional view of the resonators 10 in the first embodiment. As shown in FIG. 3, each of the resonators 10 has a body portion 12, a bottom portion 13, and a mouth portion 14. The body portion 12 is a tubular member having a hollow portion 11. The bottom portion 13 is a solid member fitted into the hollow portion 11 to close an opening of the body portion 12 on one end side. The mouth portion 14 is a tubular member fitted into the hollow portion 11 to narrow the width of an opening of the body portion 12 on the other end side. The mouth portion 14 has an opening portion 15. In this manner, each of the resonators 10 has a tubular shape or a pipe shape, includes the opening portion 15 provided on a first end face E1, and includes the bottom portion 13 provided on a second end face E2 being the opposite end face to the first end face E1. Accordingly, such a structure provides easy manufacture of the resonators 10 by processing a member such as an existing tube.

It is of note that, although it has a cylindrical shape in the present embodiment, the shape of the body portion 12 is not limited thereto. For example, the body portion 12 may have a square tube shape. In this case, the contact area of the resonators 10 with the coupling member 20 is larger than that in the present embodiment. This case has an advantage that the resonators 10 may be more easily installed on the coupling member 20.

The body portion 12, the bottom portion 13, and the mouth portion 14 may be formed integrally or may be formed as separate bodies. Respective constituent materials of these portions are freely selectable. Examples of the constituent materials include a resin material, a carbon material, a metallic material, a ceramic material, or a composite material including two or more thereof. Among these materials, a resin material is preferable because it is more easily moldable, is lighter in weight, and being lower in cost than other materials.

The resonators 10 may be formed of, for example, an elastomer material to provide the resonators 10 with pliability. This pliability enables the resonators 10 to be deformed along the wall surface 200*a*. Accordingly, the sound absorption structure 100 is easily installed on the wall surface 200*a* that is curved. Further, this pliability enables the resonators 10 to be deformed by sound pressure. Therefore, it is possible to make the frequency band wider in which the sound absorption structure 100 can absorb sound, in accordance with fluctuation of the capacities of the resonators 10.

Respective lengths L and widths W of the resonators 10 are appropriately set according to the installation location, the sound absorption characteristics, and the like of the sound absorption structure 100. In the present embodiment, the length L of the body portion 12 is greater than the width W of the body portion 12. As shown in FIGS. 1 and 2, a side surface of the body portion 12 is fixed to the coupling member 20. Accordingly, the sound absorption structure 100 can be made thinner as compared to a case in which the bottom portion 13 is fixed to the coupling member 20. Alternatively, the bottom portion 13 may be fixed to the coupling member 20. In this case, it is preferable that the length L of the body portion 12 be less than the width W of the body portion 12 in order to make the sound absorption structure 100 thinner. The respective lengths L and widths W of the resonators 10 may differ according to the resonators 10. In this case, the frequency bands in which the resonators 10 can absorb sound are made different from each other. As a result, it is possible to make the frequency band wider in which the sound absorption structure 100 can absorb sound.

As shown in FIG. 1, the resonators 10 include two resonators 10: a first resonator and a second resonator, that are arranged to face in the same direction. Therefore, the sound absorption efficiency in a predetermined direction of the sound absorption structure 100 is enhanced. The resonators 10 include two resonators 10: a third resonator and a fourth resonator, that are arranged to face in different directions from each other. Therefore, it is possible to expand the direction in which the sound absorption structure 100 can absorb sound. It is of note that the orientations, arrangement density, and the like of the resonators 10 on the coupling member 20 are not limited to those in the example shown in FIG. 1.

In the resonators 10 configured as described above, air in the hollow portion 11 and the mouth portion 14 constitutes an oscillating system using the air in the mouth portion 14 as the mass and the air in the hollow portion 11 as a spring. When this oscillating system resonates, the air in the mouth portion 14 oscillates hard, and thus, a sound absorption operation is generated due to frictional loss of the air in the mouth portion 14. When the volume in the hollow portion 11 is V, the length of the mouth portion 14 is 1, and the transverse sectional area in the mouth portion 14 is s, a resonant frequency $f_0$ of the resonators 10 is represented by the following equation (1).

$$f_0 = \frac{c}{2\pi}\sqrt{\frac{s}{V(l+\delta)}} \quad (1)$$

In this equation (1), c denotes a sound speed in the air. Further, δ denotes an opening-end correction value. When the transverse sectional shape in the mouth portion 14 is a circle, δ is represented as δ≈0.8×d where the diameter in the mouth portion 14 is d.

2. Second Embodiment

A second embodiment of the present disclosure is explained below. Elements having similar operations and functions in the embodiment exemplified below as those in the first embodiment are denoted by the reference signs used in the explanations of the first embodiment, and detailed explanations thereof are omitted as appropriate.

Figure 4:
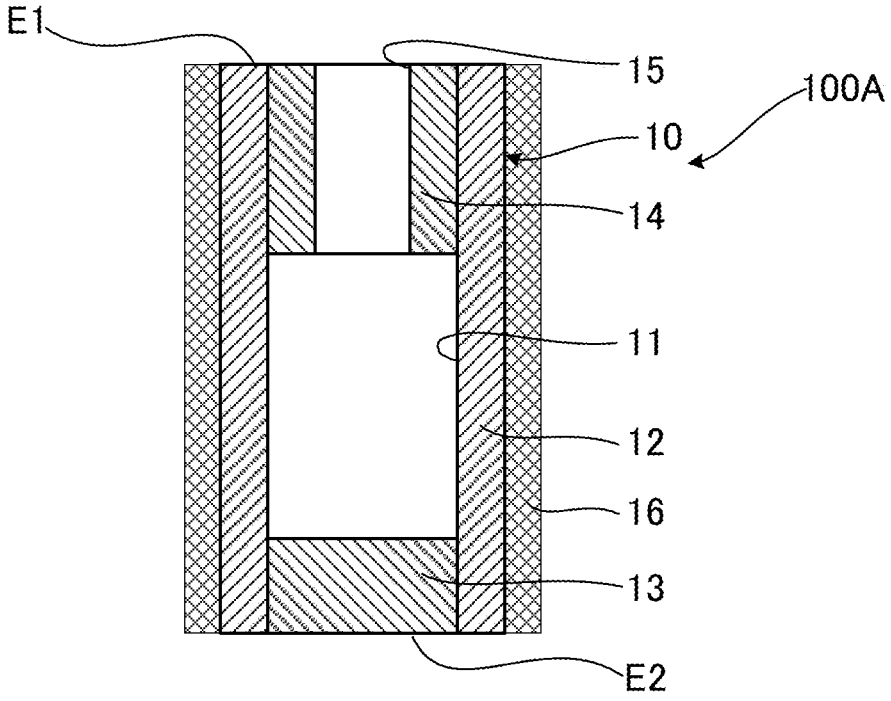
FIG. 4 is a vertical cross-sectional view of a resonator in a second embodiment.

FIG. 4 is a vertical cross-sectional view of a resonator 10A in the second embodiment. A porous material 16 is arranged on an outer surface of the resonator 10A included in a sound absorption structure 100A of the present embodiment. Therefore, it is possible to make the frequency band wider in which the sound absorption structure 100A can absorb sound as compared to a case in which the porous material 16 is not arranged. Examples of the porous material 16 include glass fiber, felt, and urethane foam. In FIG. 4, the porous material 16 is arranged on an outer circumferential surface of the body portion 12. Alternatively, the porous material 16 may be arranged on the bottom portion 13.

3. Application Example

An application example of the sound absorption structure 100 or 100A described above will be explained below.

3-1. Speaker System

Figure 5:
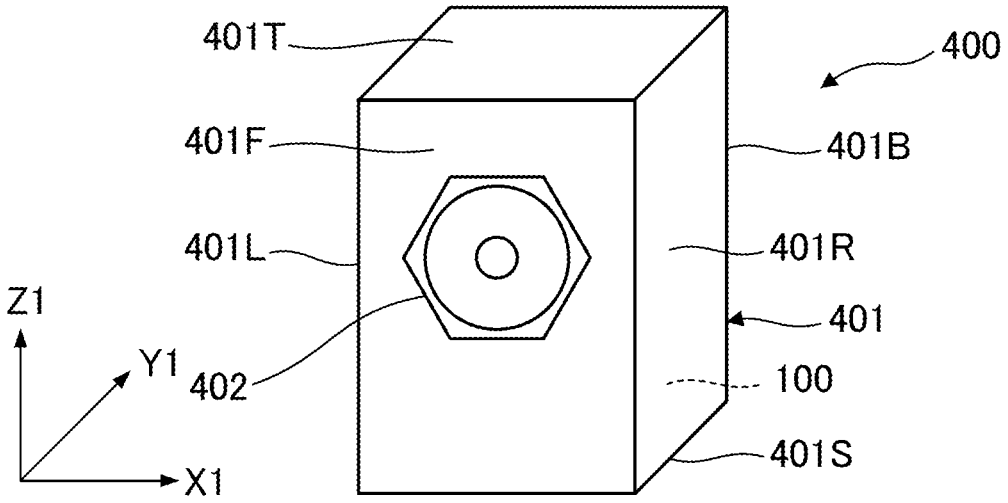
FIG. 5 is a perspective view schematically showing an application example in a case in which the sound absorption structure is installed on a speaker system.

FIG. 5 is a perspective view schematically showing an application example in a case in which the sound absorption structure 100 is installed on a speaker system 400. The speaker system 400 has a casing 401, and a speaker unit 402, and the sound absorption structure 100 attached to the casing 401. The casing 401 is a hollow cuboid having an opening portion to which the speaker unit 402 is attached. That is, the casing 401 has a right wall 401R, a left wall 401L, a front wall 401F, a back wall 401B, a top wall 401T, and a bottom wall 401S. The right wall 401R and the left wall 401L face each other in an X1 direction. The front wall 401F and the back wall 401B face each other in a Y1 direction. The top wall 401T and the bottom wall 401S face each other in a Z1 direction. It is of note that the X1 direction, the Y1 direction, and the Z1 direction shown in FIG. 5 are orthogonal to each other.

Figure 6:
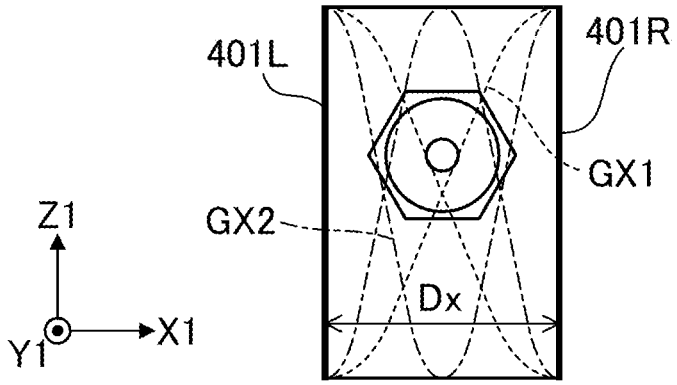
FIG. 6 is a diagram schematically showing a state of standing waves generated between a right wall and a left wall of a casing of the speaker system.
Figure 7:
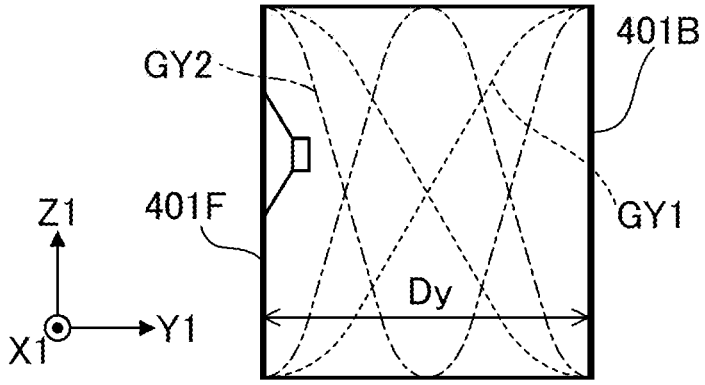
FIG. 7 is a diagram schematically showing a state of standing waves generated between a front wall and a back wall of the casing of the speaker system.
Figure 8:
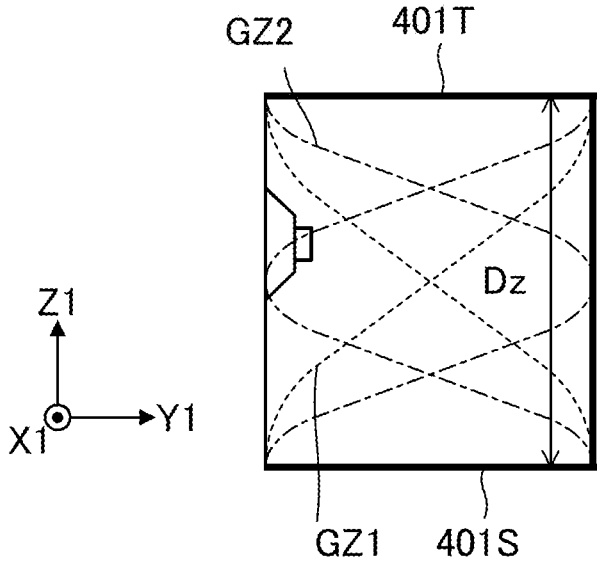
FIG. 8 is a diagram schematically showing a state of standing waves generated between a top wall and a bottom wall of the casing of the speaker system.

FIG. 6 is a diagram schematically showing a state of standing waves GX1 and GX2 generated between the right wall 401R and the left wall 401L. FIG. 7 is a diagram schematically showing a state of standing waves GY1 and GY2 generated between the front wall 401F and the back wall 401B. FIG. 8 is a diagram schematically showing a state of standing waves GZ1 and GZ2 generated between the top wall 401T and the bottom wall 401S. The standing waves GX1, GY1, GZ1, GX2, GY2, and GZ2, each shown in FIGS. 6 to 8, are standing waves in one dimension (axial waves). The standing wave GX1 is a first-order standing wave in the X1 direction. The standing wave GY1 is a first-order standing wave in the Y1 direction. The standing wave GZ1 is a first-order standing wave in the Z1 direction. The standing wave GX2 is a second-order standing wave in the X1 direction. The standing wave GY2 is a second-order standing wave in the Y1 direction. The standing wave GZ2 is a second-order standing wave in the Z1 direction. The standing waves GX1, GY1, and GZ1 each is indicated by broken lines, and the standing waves GX2, GY2, and GZ2 each is indicated by dashed-dotted lines in FIGS. 6 to 8.

The sound absorption structure 100 is installed on a part of or the entire region of the inner surface of one or more of the six walls of the casing 401 described above. For example, when the sound absorption structure 100 is installed on one or both of inner surfaces of the right wall 401R and the left wall 401L, the standing wave GX1 or GX2 described above is reduced by setting the frequency band in which the sound absorption structure 100 can absorb sound according to the frequency of the standing wave GX1 or GX2. Similarly, when the sound absorption structure 100 is installed on one or both of inner surfaces of the front wall 401F and the back wall 401B, the standing wave GY1 or GY2 described above is be reduced by setting the frequency band in which the sound absorption structure 100 can absorb sound according to the frequency of the standing wave GY1 or GY2. When the sound absorption structure 100 is installed on one or both of inner surfaces of the top wall 401T and the bottom wall 401S, the standing wave GZ1 or GZ2 described above is reduced by setting the frequency band in which the sound absorption structure 100 can absorb sound according to the frequency of the standing wave GZ1 or GZ2. As described above, the sound quality of the speaker system 400 is improved by reducing one or more of the standing waves GX1, GY1, GZ1, GX2, GY2, and GZ2.

Alternatively, the frequency band in which the sound absorption structure 100 can absorb sound may be set according to frequencies of standing waves in two dimensions (tangential waves) or standing waves in three dimensions (oblique waves). This allows for reduction of the standing waves in two dimensions or three dimensions in the casing 401. The frequency band in which the sound absorption structure 100 can absorb sound may be alternatively set according to frequencies of three or higher-order standing waves. This allows for reduction of three or higher-order standing waves in the casing 401. Although a case in which the sound absorption structure 100 is installed on the speaker system 400 is shown in FIG. 5, the sound absorption structure 100A may be used instead of the sound absorption structure 100.

3-2. Vehicle Door

Figure 9:
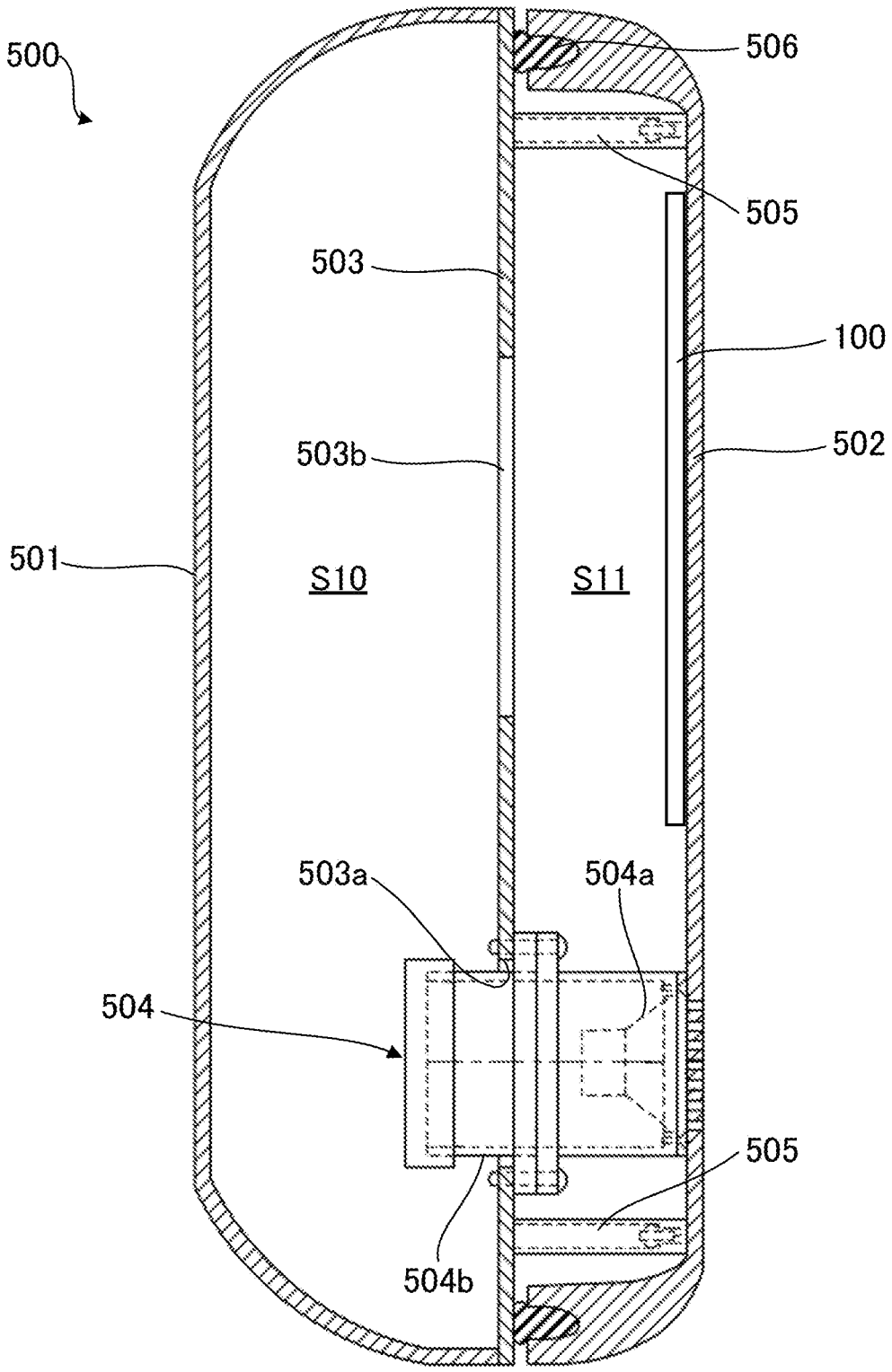
FIG. 9 is a cross-sectional view schematically showing an application example in a case in which the sound absorption structure is installed on a vehicle door.

FIG. 9 is a cross-sectional view schematically showing an application example in a case in which the sound absorption structure 100 is installed on a vehicle door 500. The door 500 shown in FIG. 9 includes a first panel 501 referred to as "outer panel", a second panel 502 referred to as "door trim", a third panel 503 referred to as "inner panel", a speaker unit 504 attached to the third panel 503, and the sound absorption structure 100 attached to the second panel 502.

The first panel 501 and the third panel 503 each is generally formed of steel plates. The first panel 501 and the third panel 503 are bonded to each other by welding, or the like. A space S10 exists between the first panel 501 and the third panel 503. There are arranged a part of the speaker unit 504, a window glass (not shown), a window-glass lifting/lowering mechanism, a door lock mechanism, and the like in the space S10. The first panel 501 or the third panel 503 may be formed of, for example, an aluminum alloy or a carbon material.

The third panel 503 is provided with opening portions 503*a* and 503*b*. The opening portion 503*a* is an attachment hole for attaching the speaker unit 504 to the third panel 503. The opening portion 503*b* is, for example, a hole used for work in the space S10 described above. The opening portion 503*b* may be closed by the sound absorption structure 100 or may be closed by a simple resin sheet.

The second panel 502 is formed of, for example, resin. The second panel 502 is fixed to the third panel 503 with coupling mechanisms 505. The coupling mechanisms 505 may be freely selected as long as they can fix the second panel 502 to the third panel 503.

A space S11 exists between the second panel 502 and the third panel 503. A part of the speaker unit 504 not arranged in the space S10 is arranged in the space S11. A packing 506 formed of rubber or the like is arranged between the second panel 502 and the third panel 503 along an outer circumference of the second panel 502.

The sound absorption structure 100 is installed on an inner surface of the second panel 502. The frequency band in which the sound absorption structure 100 can absorb sound is set, for example, according to frequencies of standing waves in the space S10 or S11 described above. This setting improves the sound quality of the speaker unit 504. Penetration of road noise and the like from outside to inside a vehicle is also reduced by appropriately setting the frequency band in which the sound absorption structure 100 can absorb sound. The wall body 200 of the sound absorption structure 100 may be integral with the second panel 502 or may be a separate body therefrom. When the wall body 200 is a separate body from the second panel 502, the wall body 200 is fixed to the second panel 502 with, for example, an adhesive or a pressure-sensitive adhesive.

The speaker unit 504 includes, for example, a speaker body 504*a*, and a tubular housing 504*b* that houses the speaker body 504*a*. The speaker body 504*a* is fixed to the housing 504*b* by screwing or the like. The housing 504*b* is fixed to the third panel 503 by screwing or the like in a state of penetrating through the opening portion 503*a* of the third panel 503.

It is of note that, although a case in which the sound absorption structure 100 is installed on the door 500 is shown in FIG. 9, the sound absorption structure 100A or a sound absorption structure 100B may be used instead of the sound absorption structure 100. Further, while the door 500 is shown in FIG. 9, the sound absorption structure 100 may be installed on a part of the vehicle other than a door, such as a roof panel or a floor panel. The sound absorption structure 100 may be alternatively installed on movable bodies other than a vehicle.

4. Modifications

The present disclosure is not limited to the respective embodiments including the application example described above, and various modifications described below can be made. The respective embodiments and the respective modifications can be combined with one another as appropriate.

4-1. First Modification

Figure 10:
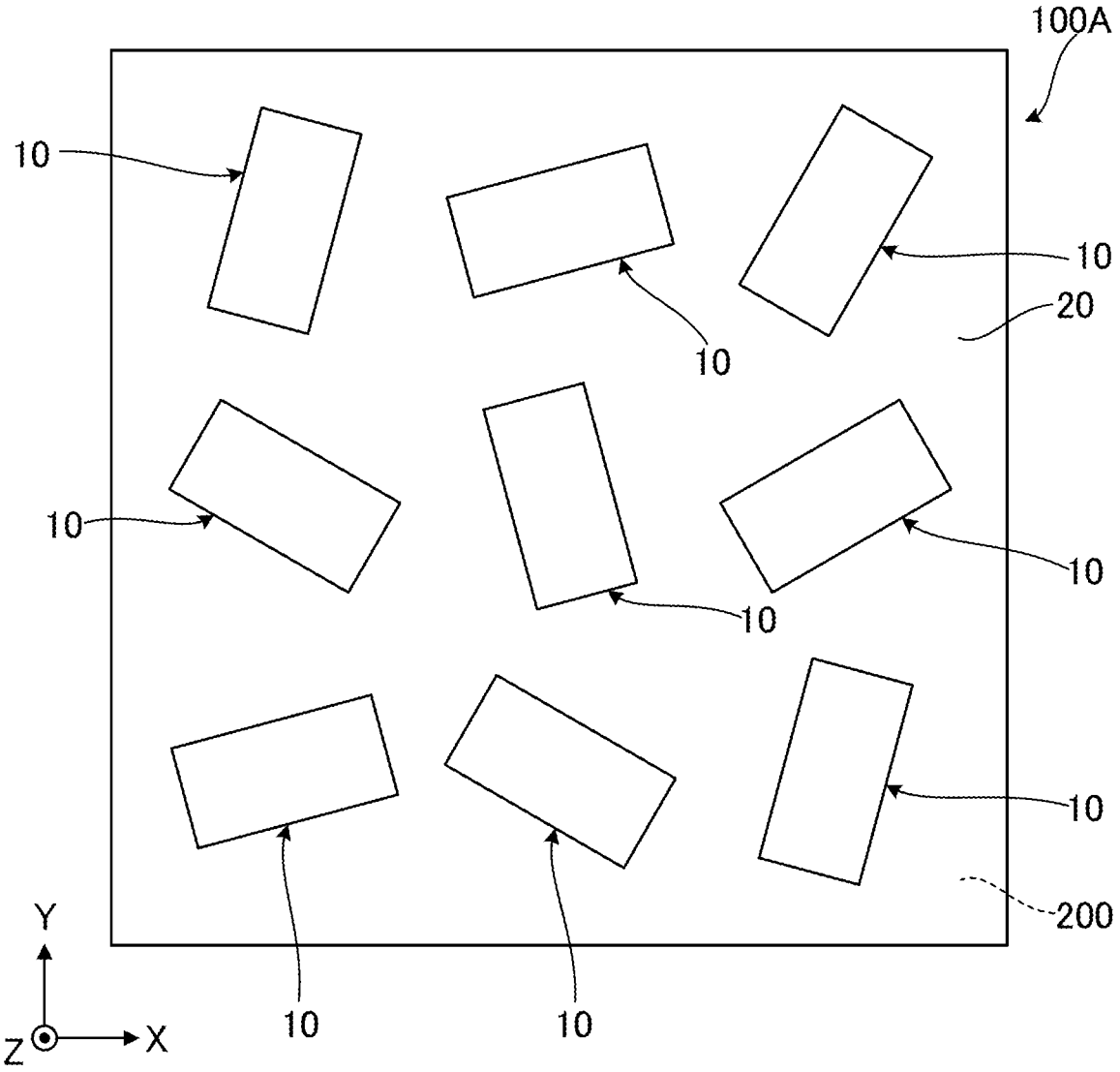
FIG. 10 is a plan view of a sound absorption structure according to a first modification.

In the embodiments described above, configurations in which the resonators 10 are regularly arranged on the coupling member 20 have been exemplified. However, the resonators 10 may be arranged in a random manner as in the sound absorption structure 100A shown in FIG. 10. This allows for making the directions uniform in which the sound absorption structure 100A can absorb sound.

4-2. Second Modification Although cases in which the resonators 10 are fixed to the coupling member 20 with an adhesive or a pressure-sensitive adhesive have been exemplified in the embodiments described above, the fixing method is not limited thereto.

Figure 11:
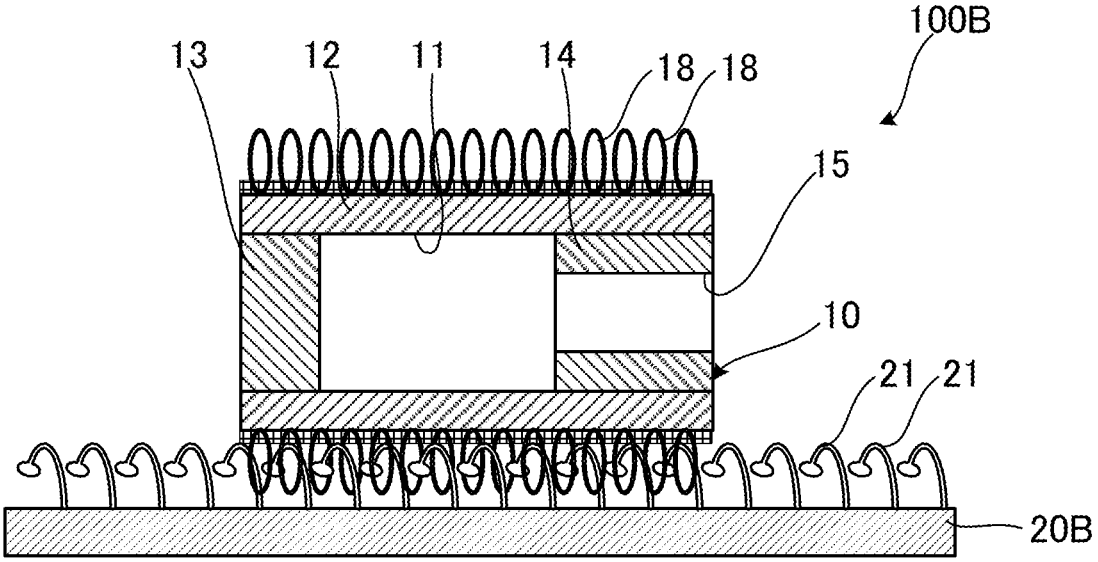
FIG. 11 is a cross-sectional view of a sound absorption structure according to a second modification.

FIG. 11 is a cross-sectional view of the sound absorption structure 100B according to a second modification. The sound absorption structure 100B of the present modification includes a coupling member 20B that removably couples the resonators 10. The resonators 10 are fixed to the coupling member 20B via loops 18 and hooks 21 coupling to each other to form a hook-and-loop fastener. In the present modification, the loops 18 are arranged on respective outer surfaces of the resonators 10. The hooks 21 are arranged on the coupling member 20B. In the sound absorption structure 100B described above, the resonators 10 are removable from the coupling member 20B. Therefore, there is an advantage in that the sound absorption characteristics of the sound absorption structure 100B are easily adjusted by changing the postures, the number, and the like of the resonators 10 fixed to the coupling member 20B. It is of note that the loops 18 may be arranged on the coupling member 20B and the hooks 21 may be arranged on the resonators 10.

4-3. Third Modification

In the embodiments described above, the coupling member 20 that couples the resonators 10 has a plate shape or a sheet shape. The shape of the coupling member that couples the resonators 10 is not limited to that in the embodiments described above. For example, the coupling member may have a string shape or a net shape. The coupling member may have a shape of a sac that houses the resonators 10 as long as the configuration does not hinder sound absorption of the resonators 10.

4-4. Fourth Modification

In the embodiments described above, the side surface of each of the resonators 10 is fixed to the coupling member 20. However, the bottom portion 13 of each of the resonators 10 may be fixed to the coupling member 20. In this case, the mouth portion 14 of each of the resonators 10 does not face the other resonators 10. Accordingly, the side surface of each of the resonators 10 may contact the other side surfaces of the resonators 10. No space is required between one and another among the resonators 10. This enables the number of the resonators 10 that are provided on the coupling member 20 per unit area to be increased and enables a sound absorption effect to be enhanced, as compared to that configuration in which the side surface of each of the resonators 10 is fixed to the coupling member 20.

5. Appendix

The following aspects are understood as examples of the present disclosure based on the embodiments and modifications exemplified above.

A sound absorption structure according to a preferred aspect (a first aspect) of the present disclosure includes a plurality of resonators that constitute separate bodies from each other and that produce Helmholtz resonance, and a pliable coupling member that couples the plurality of resonators.

According to this aspect, the plurality of resonators are coupled by the pliable coupling member, and thus, even when an installation face is a curved plane, the sound absorption structure can be installed along the installation face. Further, because the plurality of resonators constitute separate bodies from each other, the resonators can provide desired sound absorption effects, respectively, even when the sound absorption structure is installed along an installation face which is a curved plane.

In a preferred aspect (a second aspect) according to the first aspect, each of the plurality of resonators has a tubular shape or a pipe shape, includes an opening portion provided on a first end face, and includes a bottom portion provided on a second end face that is an opposite end face to the first end face.

According to this aspect, the resonators can be easily manufactured by processing a member such as an existing tube.

In a preferred aspect (a third aspect) according to the first or second aspect, each of the plurality of resonators is pliable.

According to this aspect, the resonators can be deformed along an installation face. Therefore, the sound absorption structure is easily installed on a curved installation face. Further, the resonators can be deformed by sound pressure. Accordingly, it is possible to widen the frequency band in which the sound absorption structure can absorb sound in accordance with fluctuation of the capacities of the resonators.

In a preferred aspect (a fourth aspect) according to any one of the first to third aspects, each of the plurality of resonators includes a porous material arranged on an outer surface thereof.

According to this aspect, it is possible to widen the frequency band in which the sound absorption structure can absorb sound as compared to a case of using no porous material.

In a preferred aspect (a fifth aspect) according to any one of the first to fourth aspects, the plurality of resonators includes a first resonator and a second resonator arranged to face in a same direction.

According to this aspect, it is possible to enhance the sound absorption efficiency in a predetermined direction of the sound absorption structure.

In a preferred aspect (a sixth aspect) according to any one of the first to fifth aspects, the plurality of resonators includes a third resonator and a fourth resonator arranged to face in different directions from each other.

According to this aspect, it is possible to expand the direction in which the sound absorption structure can absorb sound.

In a preferred aspect (a seventh aspect) according to any one of the first to sixth aspects, the coupling member has a sheet shape or a plate shape.

According to this aspect, the sound absorption structure is easily handled before installation or when it is installed.

DESCRIPTION OF REFERENCE SIGNS

10 . . . resonator, 10A . . . resonator, 13 . . . bottom portion, 15 . . . opening portion, 16 . . . porous material, 20 . . . coupling member, 20B . . . coupling member, 100 . . . sound absorption structure, 100A . . . sound absorption structure, 100B . . . sound absorption structure, E1 . . . first end face, E2 . . . second end face.

What is claimed is:

1. A sound absorption structure comprising:

a plurality of resonators that constitute separate bodies from each other and that produce Helmholtz resonance; and a pliable coupling member that couples the plurality of resonators, wherein each of the plurality of resonators includes an opening portion provided on a first end face, a bottom portion provided on a second end face that is an opposite end face to the first end face, and a body portion provided on a side surface that is different from the first end face and the second end face, each of the plurality of resonators has a tubular shape or a pipe shape, each of the plurality of resonators is pliable, and each of the plurality of resonators is fixed to the pliable coupling member via the side surface of the body portion with adhesive, pressure-sensitive adhesive or a hook-and-loop fastener.

2. The sound absorption structure according to claim 1, wherein each of the plurality of resonators includes a porous material arranged on an outer surface thereof.

3. The sound absorption structure according to claim 1, wherein the plurality of resonators includes a first resonator and a second resonator arranged to face in a same direction.

4. The sound absorption structure according to claim 1, wherein the plurality of resonators includes a third resonator and a fourth resonator arranged to face in different directions from each other.

5. The sound absorption structure according to claim 1, wherein the coupling member has a sheet shape or a plate shape.

* * * * *